US005906514A

United States Patent [19]

Nelson, Jr.

[11] Patent Number: 5,906,514

[45] Date of Patent: May 25, 1999

[54] REMOVABLE AUTOMOTIVE FUSE BLOCK

[76] Inventor: James Edward Nelson, Jr., 2801 Glen Flora Ave., Apt. 307, Waukegan, Ill. 60085

[21] Appl. No.: 08/938,665

[22] Filed: Sep. 26, 1997

[51] Int. Cl.[6] ..... H01R 13/68

[52] U.S. Cl. ..... 439/621; 439/952; 307/10.4; 180/287

[58] Field of Search ..... 439/34, 621, 952; 307/10.2–10.6; 180/287; 340/425.5, 426, 825.3, 825.31, 825.32, 825.69, 825.12; 361/833, 834, 835

[56] References Cited

U.S. PATENT DOCUMENTS

| | | | |
|---|---|---|---|
| D. 305,531 | 1/1990 | Suzuki et al. | D13/24 |
| 3,975,708 | 8/1976 | Lusk et al. | 340/80 |
| 4,035,754 | 7/1977 | Kleinbohl | 337/206 |
| 4,238,140 | 12/1980 | Cairns et al. | 439/621 |
| 4,278,963 | 7/1981 | Allen | 340/64 |
| 4,687,270 | 8/1987 | Plylet et al. | 439/350 |
| 5,038,050 | 8/1991 | Minoura | 439/621 |
| 5,257,951 | 11/1993 | Maeda | 439/752 |
| 5,585,779 | 12/1996 | Halikias | 340/426 |
| 5,841,337 | 11/1998 | Douglass | 361/833 |

*Primary Examiner*—Paula Bradley
*Assistant Examiner*—Katrina Davis
*Attorney, Agent, or Firm*—Goldstein & Canino

[57] ABSTRACT

A removable automotive fuse block assembly for mounting to an automobile and disabling vital automotive electrical systems, comprising a fixed fuse block casement which is mounted to the automobile in a permanent fashion. A removable fuse block segment engages the fixed fuse block casement, both the fixed fuse block casement and removable fuse block segment having receptacles with electrical fuses contained therein which are in electrical communication with various automobile system circuits. The assembly is configured so that when the removable fuse block segment is disengaged from the fixed fuse block casement, vital automobile system circuitry is broken, and the automobile rendered inoperable. It is envisioned that an operator of the automobile, upon exiting, will disengage the removable fuse block segment and carry it with him, thus leaving the automobile in a non-functional state.

4 Claims, 3 Drawing Sheets

REMOVABLE AUTOMOTIVE FUSE BLOCK

FIELD OF THE INVENTION

The invention relates to a removable automotive fuse block. More particularly, the invention relates to an automotive fuse block wherein a removable portion of the fuse block is detachably secured to a main body. When leaving the automobile, a user may remove the removable portion from the main body, thus rendering the main electrical functions of the automobile inoperable and preventing theft of the automobile.

BACKGROUND OF THE INVENTION

Numerous types of anti-theft devices are currently manufactured. One type of such device prevents operation of the automobile by interrupting the automobile ignition circuit upon detecting unauthorized access to the automobile. Typically, this system interfaces with the automobile ignition coil, and prevents the energizing thereof to interrupt the ignition circuit. Unfortunately, however, a malfunction of any component of this type of anti-theft system results in the inability of the automobile to be started, or worse yet, results in a loss of power while the automobile is underway.

Another type of anti-theft device employed commonly in automobiles is an audible alarm which is triggered upon unauthorized entry into the automobile. These types of systems typically involve a number of complicated trigger switches placed strategically about the automobile at key locations such as the door, trunk, hood and the like. The audible alarm is intended to thwart would-be thieves by causing them to flee before they are able to disarm the system and/or start the automobile. However, a brazen thief will simply work towards starting the automobile despite the loud audible alarm, and a sophisticated thief will simply disable the audible alarm soon after it's activation.

While these units may be suitable for the particular purpose employed, or for general use, they would not be as suitable for the purposes of the present invention as disclosed hereafter.

SUMMARY OF THE INVENTION

It is an object of the invention to produce a removable automotive fuse block.

It is another object of the invention to produce an automotive fuse block wherein a removable portion of fuse block is detachably secured to a main body, such that a user may, upon exiting the automobile, remove said removable portion and thus disable the automobile.

It is a further object of the invention to produce a removable automotive fuse block which provides anti-theft qualities without interfering with the normal vehicular ignition system.

It is a still further object of the invention to produce a removable automotive fuse block which provides anti-theft qualities yet requires no key to engage or disengage the system.

Further in accordance with the instant invention, a removable automotive fuse block is provided which is easily installed within the subject automobile, and upon removal of a removable portion from a main body, renders inoperable the automobile's entire electrical system of select features thereof.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
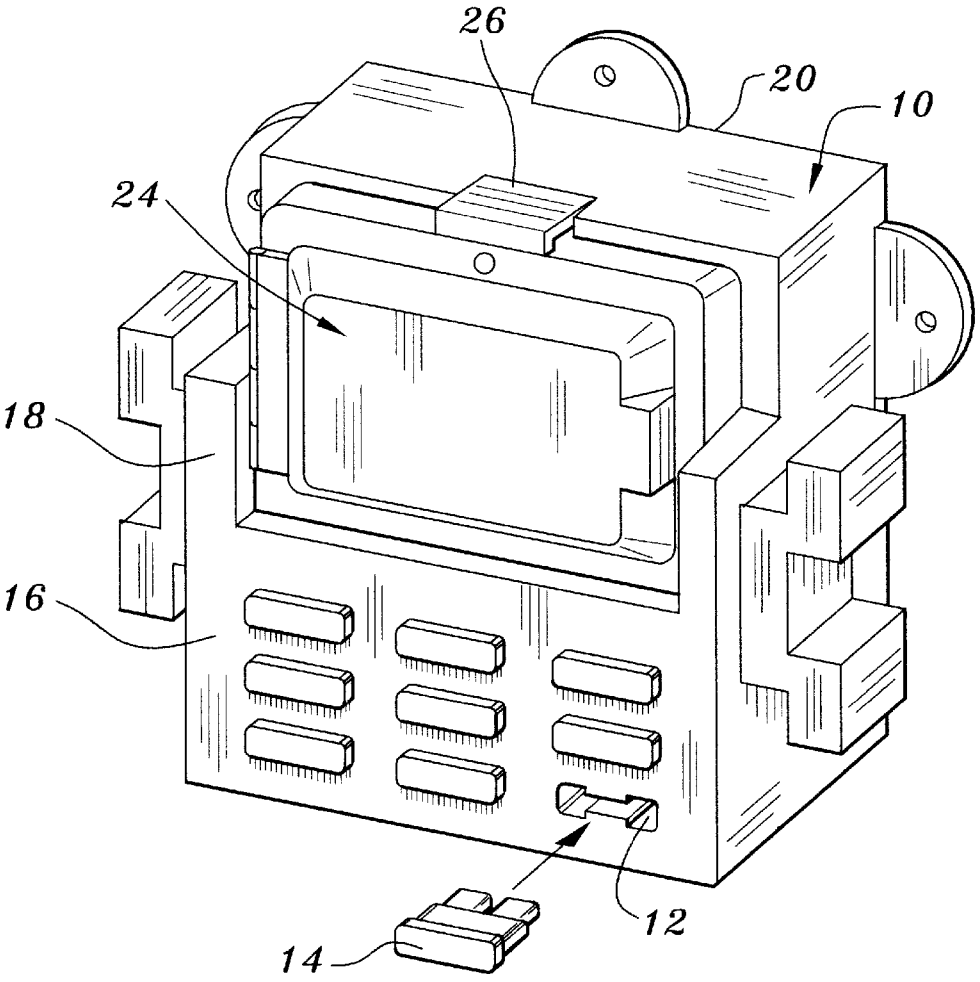
FIG. 1 is a diagrammatic perspective view of a removable automotive fuse block assembly.

FIG. 1 illustrates a removable automotive fuse block assembly 10. Typically, automotive fuse block assemblies are mounted under the foot wells of the driver or passenger side of a automobile, or within the glove box or any other area easily accessible. A plurality of apertures 12 which function as receptacles for electrical fuses 14 are disposed upon a front face 16 of the removable automotive fuse block assembly 10. In standard fuse block assemblies, a wiring harness (not shown) typically brings each individual electrical fuse 14 into electrical communication with the appropriate system circuit of the automobile intended to be protected by the particular electrical fuse 14. A dangerous surge of power through a particular system circuit would, rather than damage elements of that system, simply "blow" the relevant sacrificial electrical fuse 14. An electrical fuse 14 which is blown or removed from its' receptacle 12 renders that particular system circuit inoperable until a functional electrical fuse 14 is inserted into the receptacle 12. Accordingly, various systems of the automotive electrical system can be rendered inoperable by removing the relevant electrical fuses 14.

With the above mentioned facts in mind, the instant invention contemplates an anti-theft device which disables one or more entire electrical systems of the automobile by removing the relevant system fuse 14 from the system circuit, hence breaking the circuit. This system is preferable to a system wherein electrical current is cut-off from an individual component of an entire system since in such a system the deactivated component may be easily re-activated through the simple re-routing of one or two wires in order to bring current to the de-activated component. In the system contemplated by the instant invention, an entire electrical circuit, and hence all components within the circuit, is deactivated.

While an entire electrical circuit can be disabled by simply removing the relevant electrical fuse 14, this method alone would prove ineffective in that a potential thief could simply replace the missing electrical fuse 14 with one of his own. Accordingly, the instant invention contemplates removing a portion of the automotive fuse block itself.

Figure 2:
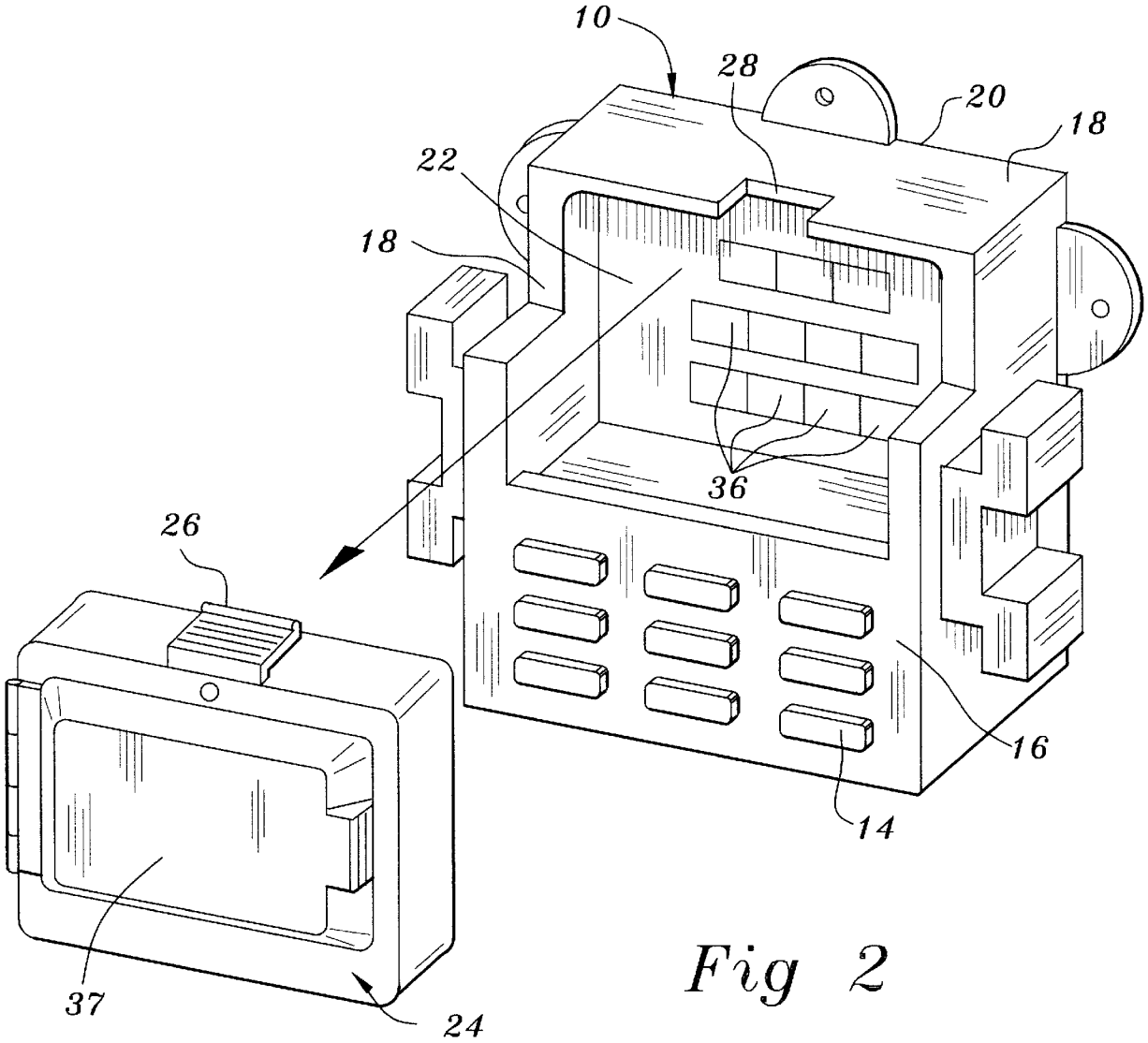
FIG. 2 depicts a fixed fuse block casement and removable fuse block segment being withdrawn therefrom, both components comprising the removable automotive fuse block assembly.
Figure 4:
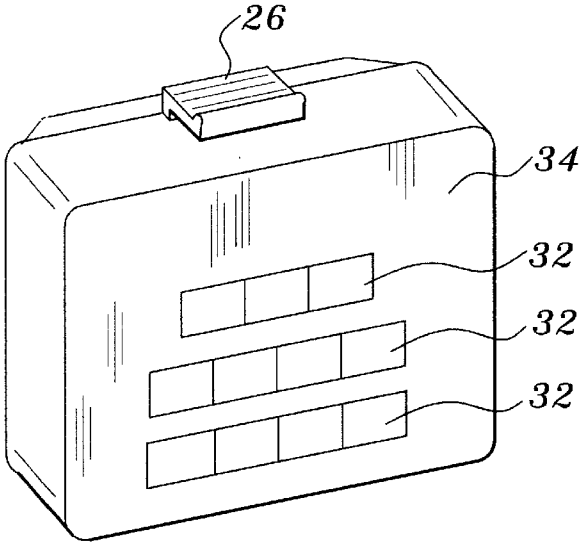
FIG. 4 is a rear elevational view of the removable fuse block segment.

Referring to FIGS. 1 and 2, the removable automotive fuse block assembly 10 can be seen. The removable automotive fuse block assembly 10 comprises a fixed fuse block casement 18 having a front face 16 and opposite rear face 20. The removable automotive fuse block assembly 10 is preferably installed within the automobile so that the front face 16 of the fixed fuse block casement 18 faces outward toward the operator, with the automobile's electrical system wiring (not shown) entering through the rear face 20, thus bringing the fixed fuse block casement 18 into electrical contact with all system electrical circuits of the automobile. A cavity 22 located within the fixed fuse block casement 18 is sized to accept a correspondingly sized removable fuse block segment 24. In FIG. 1, the removable fuse block segment 24 is shown installed within the cavity 22 of the fixed fuse block casement 18, while in FIG. 2 it is shown removed therefrom.

Securing means located upon the removable fuse block segment 24 cause said removable fuse block segment 24 to be removeably retained firmly within the cavity 22 of the fixed fuse block casement 18. For example, as seen in FIGS. 1 and 2, a tab 26 protrudes outward from the removable fuse block segment 24, and engages a notch 28 located within the cavity 22. Accordingly, the removable fuse block segment 24 may be removed from the cavity 22 by depressing the tab 26 to release said tab 26 from the notch 28.

Figure 3:
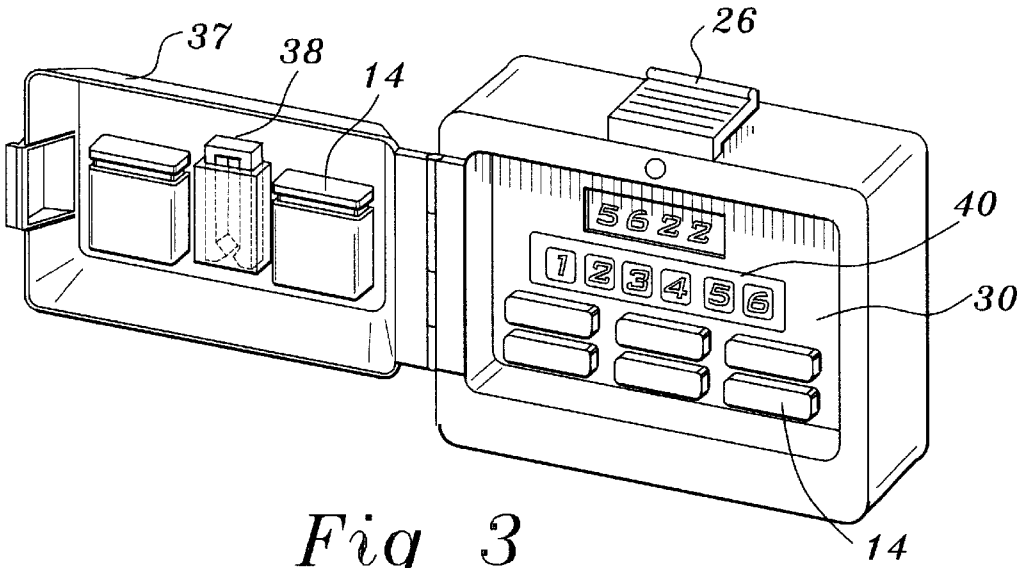
FIG. 3 illustrates the removable fuse block segment with a front cover shown in an open position to expose a plurality of fuses contained upon a front face.

As seen in FIG. 3, the removable fuse block segment 24 possess a panel 30 which has a plurality of electrical fuses 14 installed thereupon. The electrical fuses 14 are further in electrical circuitry with a series of segment contact leads 32 which are disposed upon a rear side 34 of the removable fuse block segment 24, said rear side 34 located opposite the panel 30. A corresponding series of contact leads, termed cavity contact leads 36 are located within the cavity 22 of the fixed fuse block casement 18. When the removable fuse block segment 24 is inserted and contained within the cavity 22, the segment contact leads 32 touch the cavity contact leads 36 so that electrical current may travel therethrough, with the electrical fuses completing an electrical circuit between the automobile power source (not shown) and distinct electrical systems (i.e. ignition, brakes, steering, etc.) of the automobile. Accordingly, the electrical fuses 14 of said removable fuse block segment 24 function in conjunction with the entire automobile electrical system. If the removable fuse block segment 24 is removed from the cavity 22, the electrical circuits which are completed by the electrical fuses 14 of said removable fuse block segment 24 will be broken, and those systems rendered inoperable.

The electrical fuses 14 found on the panel 30 of the removable fuse block segment 24 can vary in number, but essentially should complete the electrical circuits of only those automobile systems which permit the automobile to be driven. For instance, electrical systems contemplated would be the entire ignition system, power steering/brakes system, and any other systems needed to drive the automobile a short distance. Ancillary systems which do not effect the overall mobility of the automobile, such as turn signal lamps, radio functions, power windows/door locks and the like need not be represented on the removable fuse block segment 24, but should instead be protected by and in circuit with the electrical fuses 14 found on the fixed fuse block casement 18. By configuring the removable automotive fuse block assembly 10 in this fashion, the majority of the automobile's electrical fuses 14 will remain located in the fixed fuse block casement 18, while the vital system electrical fuses 14 can be removed by the operator by removing the less bulky removable fuse block segment 24 upon exiting the automobile.

In a preferred embodiment of the instant invention, covering means such as a hinged door 37 cover the panel 30 of the removable fuse block segment 24, thus covering the electrical fuses 14 located thereupon. Accordingly, when the removable fuse block segment 24 is removed from the cavity 22 of the fixed fuse block casement 18 by a user, said removable fuse block segment 24 may be safely transported outside of the automobile without any threat of damage to the electrical fuses 14. It is contemplated that spare electrical fuses 14 and a fuse puller 38 be secured to the hinged door 37 in the event needed. It should be understood that when the removable fuse block segment 24 is contained within the cavity 22 and functional electrical fuses 14 are retained within the receptacles 12 of said removable fuse block segment 24, the automobile may function normally, and the removable automotive fuse block assembly 10 functions as a standard protective fuse block.

Finally, it is further contemplated by the instant invention that a key-pad 40 be present within the removable fuse block segment 24, such as upon the panel 30. Lock-out circuitry, as is well understood by those skilled in the art, will be contained within each removable fuse block segment 24, requiring a specific identification code to be entered into the keypad 40 before allowing the removable fuse block segment 24 to complete system circuits upon insertion into the cavity 22. Accordingly, a would-be thief is prevented from entering a automobile utilizing the instant inventive system and simply inserting his own removable fuse block segment 24 into the cavity 22 of the fixed fuse block casement 18 contained within the automobile in an attempt to complete all vital system circuits and steal the automobile.

What is claimed is:

1. A removable automotive fuse block assembly for mounting to an automobile and disabling vital automotive electrical systems, comprising:

a) a fixed fuse block casement, the fixed fuse block casement in electrical communication with all automobile system electrical circuits;

b) a removable fuse block segment, capable of engaging the fixed fuse block casement;

c) securing means to removeably secure the removable fuse block segment to the fixed fuse block casement;

d) a plurality of receptacles located upon the fixed fuse block casement and removable fuse block segment, each receptacle of the fixed fuse block casement in electrical communication with a particular automobile system electrical circuit;

e) a plurality of electrical fuses, each fuse sized to removeably engage one of the plurality of receptacles, such that when each electrical fuse is fitted within each receptacle, the flow of electrical current therethrough is permitted;

f) a plurality of segment contact leads located upon the removable fuse block segment, corresponding in number to the number of receptacles located upon said removable fuse block segment, each segment contact lead in electrical communication with one of said receptacles; and g) a plurality of cavity contact leads located upon the fixed fuse block casement, corresponding in number and placement to the number and placement of segment contact leads, and in electrical communication with those automobile system electrical circuits needed to start and propel the automobile;

whereby when the removable fuse block segment is removeably secured to the fixed fuse block casement with functional fuses in place within the receptacles so that all vital system electrical circuits are complete, the automobile will be fully functional, but upon removing the removable fuse block segment and breaking the contact between the cavity contact leads and segment contact leads, those vital system electrical circuits which are in communication with the removable fuse block segment will be broken, and the automobile rendered inoperable.

2. A removable automotive fuse block assembly for mounting to an automobile and disabling vital automotive electrical systems, comprising:

a) a fixed fuse block casement having a front face and opposite rear face, the fixed fuse block casement in electrical communication with all automobile system electrical circuits, and mounted to the automobile such that the front face is accessible to an operator of said automobile;

b) a cavity located within the fixed fuse block casement;

c) a removable fuse block segment, sized to fit within the cavity of the fixed fuse block casement;

d) securing means to removeably secure the removable fuse block segment within the cavity of the fixed fuse block casement;

e) a plurality of receptacles located upon the fixed fuse block casement and removable fuse block segment, each receptacle of the fixed fuse block casement in electrical communication with a particular automobile system electrical circuit;

f) a plurality of electrical fuses, each fuse sized to removeably engage one of the plurality of receptacles, such that when each electrical fuse is fitted within each receptacles, the flow of electrical current therethrough is permitted;

g) a plurality of segment contact leads located upon the removable fuse block segment, corresponding in number to the number of receptacles located upon said removable fuse block segment, each segment contact lead in electrical communication with one of said receptacles; and h) a plurality of cavity contact leads located within the cavity of the fixed fuse block casement, corresponding in number and placement to the number and placement of segment contact leads, and in electrical communication with those automobile system electrical circuits needed to start and propel the automobile;

whereby when the removable fuse block segment is removeably secured within the cavity with functional fuses in place within the receptacles so that all vital system electrical circuits are complete, the automobile will be fully functional, but upon removing the removable fuse block segment from the cavity and breaking the contact between the cavity contact leads and segment contact leads, those vital system electrical circuits which are in communication with the removable fuse block segment will be broken, and the automobile rendered inoperable.

3. The removable automotive fuse block assembly of claim 2, wherein covering means are located upon the removable fuse block segment to cover and protect the electrical fuses secured thereto, so that said electrical fuses will not be damaged upon the removable fuse block segment being removed from and transported outside of the automobile.

4. The removable automotive fuse block assembly of claim 3, wherein a key pad is located upon the removable fuse block segment, and lock-out circuitry is contained within the removable fuse block segment, requiring a specific identification code to be entered into the keypad before allowing the removable fuse block segment to complete system electrical circuits upon insertion into the cavity.

* * * * *